US005183106A

United States Patent [19]

Stancliffe et al.

[11] Patent Number: 5,183,106

[45] Date of Patent: Feb. 2, 1993

[54] HEAT EXCHANGE

[75] Inventors: A. Colin Stancliffe; Paul Vidano, both of Redondo Beach; Bill P. Pogue, San Pedro, all of Calif.

[73] Assignee: Allied-Signal Inc., Morris Township, Morris County, N.J.

[21] Appl. No.: 873,912

[22] Filed: Apr. 24, 1992

[51] Int. Cl.[5] ..... F28F 3/08

[52] U.S. Cl. ..... 165/166; 165/78

[58] Field of Search ..... 165/166, 76, 78

[56] References Cited

U.S. PATENT DOCUMENTS

| | | | |
|---|---|---|---|
| 2,368,814 | 2/1945 | Fagan | 165/166 |
| 2,959,400 | 11/1960 | Simpelaar | 165/166 |
| 2,985,433 | 5/1961 | Simpelaar | 165/166 |
| 3,247,899 | 4/1966 | Branch | 165/166 |
| 3,265,129 | 8/1966 | Bawabe | 165/166 |
| 3,627,039 | 12/1971 | Tiefenbacher | 165/158 |
| 4,301,863 | 11/1981 | Bizzarro | 165/166 |
| 4,473,111 | 9/1984 | Steeb | 165/153 |
| 4,681,155 | 7/1987 | Kredo | 165/166 |
| 4,719,970 | 1/1988 | Fayolle | 165/166 |

FOREIGN PATENT DOCUMENTS

| | | | |
|---|---|---|---|
| 54796 | 6/1982 | European Pat. Off. | 165/166 |
| 576974 | 8/1932 | Fed. Rep. of Germany | 165/166 |
| 2450739 | 4/1976 | Fed. Rep. of Germany | 165/166 |
| 669175 | 6/1979 | U.S.S.R. | 165/166 |

*Primary Examiner*—John Rivell
*Assistant Examiner*—L. R. Leo
*Attorney, Agent, or Firm*—Terry L. Miller; James W. McFarland; Robert A. Walsh

[57] ABSTRACT

A bar-and-plate type heat exchanger includes corner bar members which interlock with end extension portions of the header bars to sealingly close the heat exchanger corners and facilitate plenum chamber welding thereto with diminished risk of leakage.

9 Claims, 3 Drawing Sheets

FIG. 1
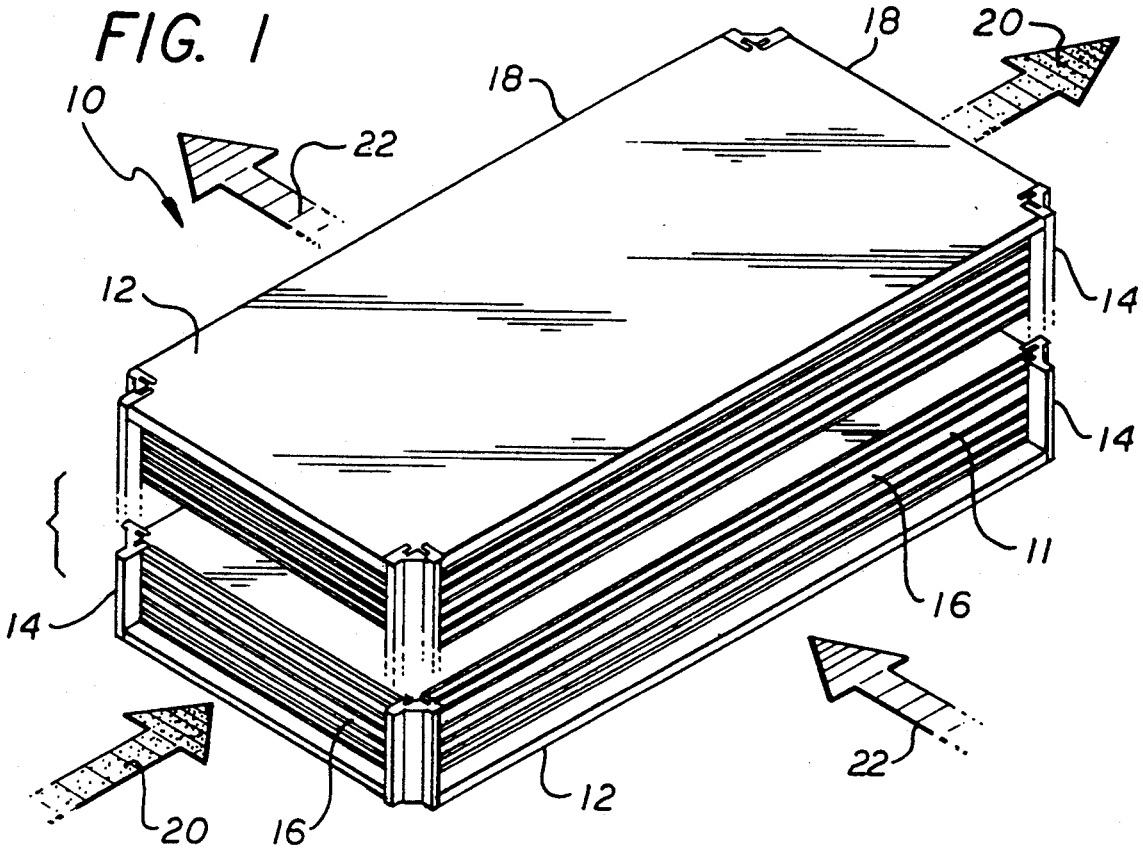
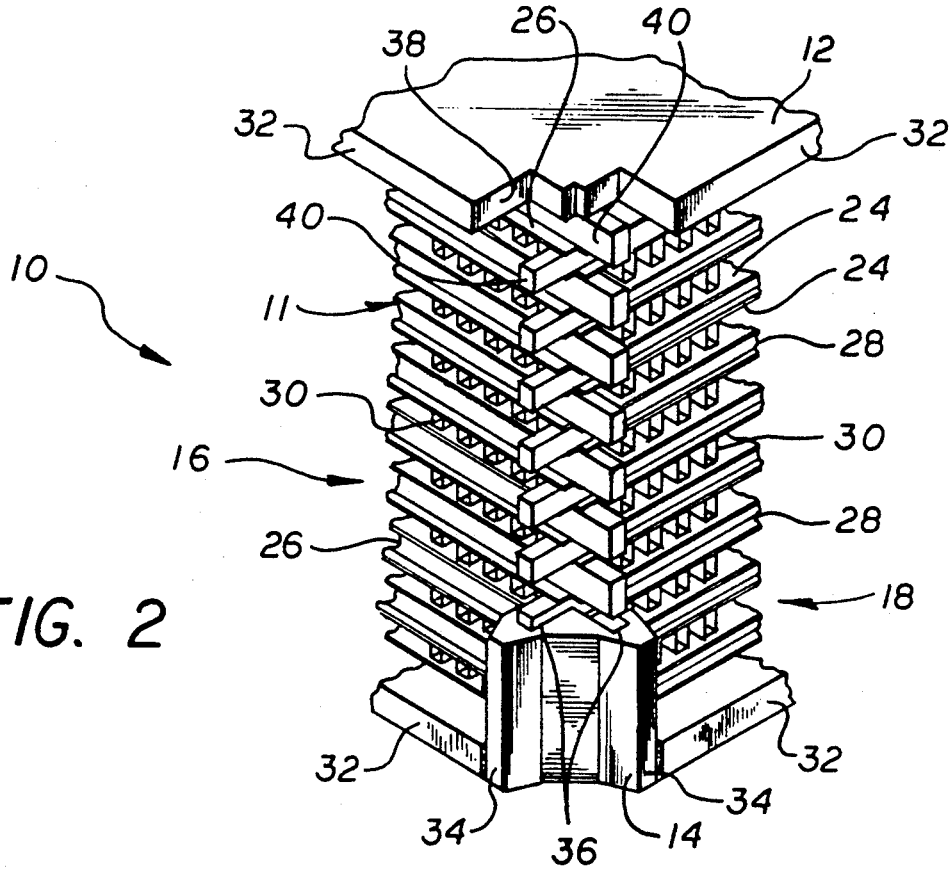
FIG. 2

HEAT EXCHANGE

The present invention is in the field of heat exchangers for transferring heat energy between fluid streams. More particularly, the present invention relates to a heat exchanger of the bar-and-plate type wherein a plurality of stacked plate members are spaced apart to separate heat exchange fluid streams. A plurality of bar members are stacked with the plate members in laterally spaced pairs to both space apart the plate members and to laterally bound the fluid streams. The bar members of successive layers of the heat exchanger stack run angularly to one another to bound the respective fluid streams laterally and to direct these fluid streams angularly to one another. A corner bar member at each corner of the heat exchanger both cooperates with the bar members to complete the structure of the heat exchanger and to provide a surface to which manifolding or plenum structure may attach for conducting the fluid streams to and from the heat exchanger.

The closest technology known to the applicants is set forth in U.S. Pat. 2,959,400; issued Nov. 8, 1960 to C. S. Simpelaar. The '400 patent is believed to teach a plate type heat exchanger wherein adjacent plates are simply brought together at the faces of the heat exchanger and are there sealed together without spacer bars at approximately a mid-plane level of each fluid stream in the stack. That is, the plates are substantially planar and are at their marginal edges offset sufficiently to cojoin with next adjacent plates in the stack to define a seam. Because at the corners of the heat exchanger each plate must be part of two seams which have different levels in the stack, Simpelaar provides a corner member with a web extending into the stack of plates and away from the corner. By joining the plates with the surface of this corner member web, a transition length is provided to allow for the different levels each plate must have at its marginal edge portion to participate in the seaming of adjacent plates. The corner members, along with closure plates at the top and bottom of the heat exchanger stack also provide for mounting of manifolding to the heat exchanger.

The present invention is described by reference to three embodiments depicted in the following drawing Figures, in which:

FIG. 1 is a perspective view of a heat exchanger embodying the invention;

FIG. 2 is an enlarged fragmentary view of the heat exchanger of FIG. 1, and having components broken away to better illustrate the structure of the heat exchanger;

Figure 3:
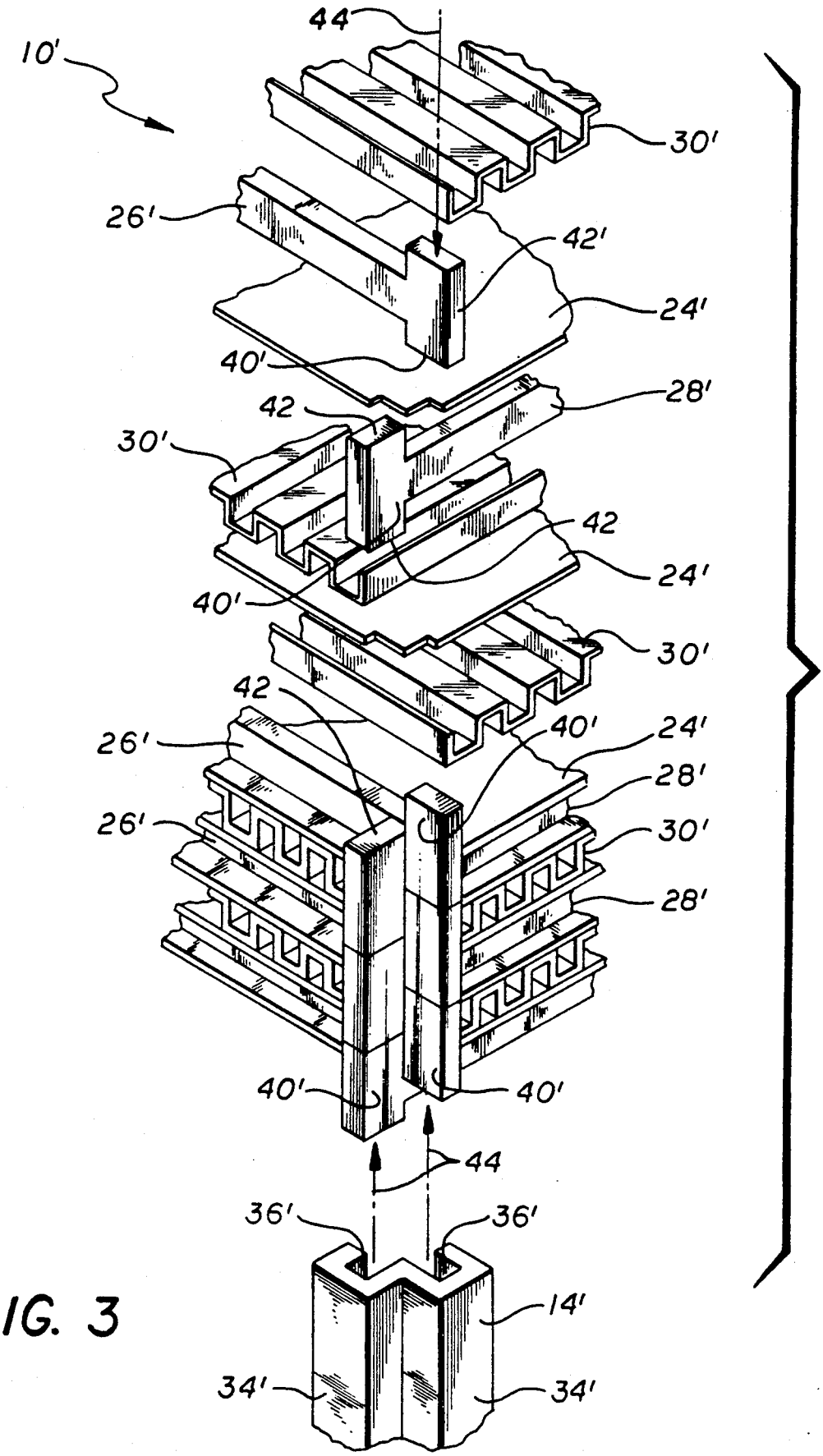
Figure 4:
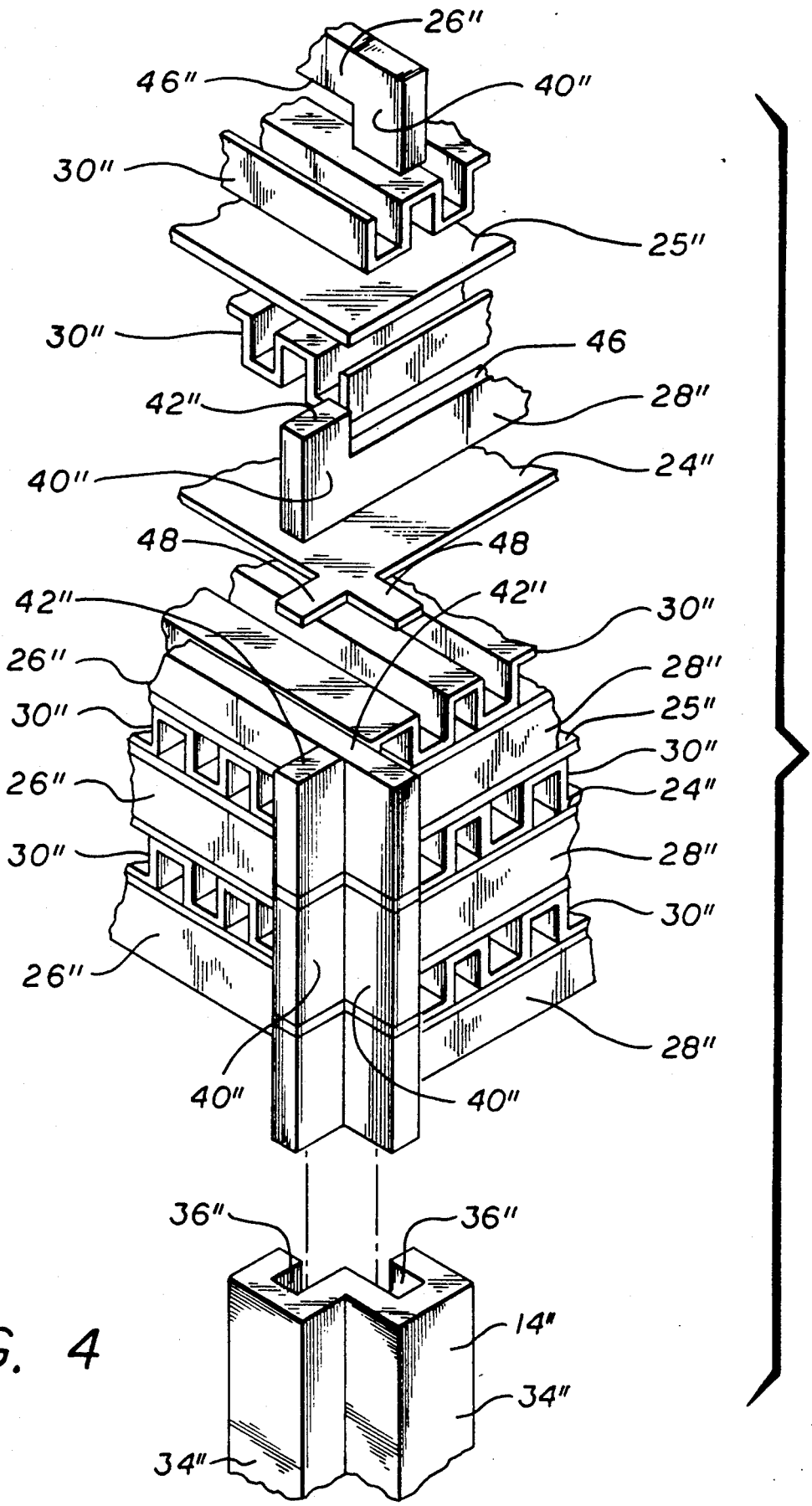

FIGS. 3 and 4 an enlarged fragmentary views like FIG. 2, but are exploded to better illustrate the structure of the heat exchanger, and each depict an alternative embodiment of the invention;

Viewing now FIG. 1, rectangular heat exchanger 10 is shown in perspective view. Heat exchanger 10 includes top and bottom closure plate members 12 receiving therebetween a core portion 11 of the heat exchanger which will be more fully explained below. Extending vertically between the top and bottom closure plate members 12 are four corner bar members 14 which in cooperation with the closure members 12 bound inlet and outlet faces 16 and 18. The faces 16, 18 provide respectively for both introduction into and exit of separate heat exchange fluid streams which are referenced with the respective solid arrows 20 and open arrows 22.

FIG. 2 depicts a portion of the heat exchanger 10 at a corner bar 14. Received between the top and bottom closure plates 12 are a plurality of plate members 24 which are spaced apart by a like plurality of paired angularly disposed bar members referenced with the numerals 26 and 28. The bar members 26 are alternated with the bar members 28 in pairs and respectively space apart adjacent plate members 24 in order to define flow paths for the respective fluid streams 20 and 22.

Received between the plate members 24 and extending in alternate perpendicular directions is a plurality of rightangle bend serpentine fin sheet members referenced with the numeral 30. These fin sheet members are fine-dimension sheet metal material having parallel 90 degree bends therein to form a right angle serpentine shape and are bonded to the plate members 24 during a furnace brazing operation which unites the heat exchanger 10 into a unitary structure. As is depicted in FIG. 2, the bar members 26 and 28 extend slightly beyond the corners of the plate members 24, to terminate in extending end portions 40, and define thereat a cruciform when viewed plan view.

The corner bar members 14 are double-U shape in cross section and define a pair of channels 36, which will be more fully described hereinafter. The corner bar members 14 receive into the channels 36 thereof, the extending end portions of the bars 26 and 28. Before leaving FIG. 2, it is appropriate to note that the top and bottom closure plate members 12 along with the corner bar members 14 define respective plenum or manifold mounting surfaces 32 and 34 to which plenums or manifolds may be welded for introducing the fluid streams 20 and 22 into and out of the heat exchanger 10. Also viewing FIG. 2, it will be seen that each of the top and bottom closure plates 12 is notched at 38, similarly to the corners of the plates 24 to receive the vertical corner bar members 14.

Viewing now FIG. 3, an alternative embodiment of a heat exchanger similar to that illustrated in FIG. 2 is depicted. Because many of the structural features seen in FIG. 3 are similar in structure and function to those depicted in FIG. 2, the same reference numeral used with respect to FIG. 2, is used in FIG. 3 with a prime added thereto. Viewing FIG. 3 it will be seen that the bar members 26' and 28' include end portions 40' which are (in cooperation with the remainder of each bar member) generally T-shaped. Those ordinarily skilled in the heat exchanger art will recognize that the bar members are of differing lengths depending upon the dimensions of the heat exchanger when viewed in plan view, and that the structure depicted at the illustrated corner of the heat exchanger is repeated at the opposite end of the bar members so that depiction of all of these duplicated features is not necessary. Because the T-shaped end portions 40' are repeated at the opposite ends of the bar members, these bar members may also be visualized as being I-shaped. That is the T-shape is repeated with a cross bar at each end.

Viewing FIG. 3 it is seen that the bar members 26' and 28' are stacked together along with the plates 24' and the fine-dimension fin sheet numbers 30' in a repeating alternating stack. The bar members 26' and 28' have T-shaped end portions 40' of sufficient vertical dimension that when stacked together these cross bars of the T-shaped end portions define abutment surfaces 42 which confront and touch one another in the stacked condition of the bar members 26' and 28'. Those skilled in the heat exchanger art will recognize that the plates 24' and bars 26', 28', are formed from sheet material which has on it's planar surfaces a coating of braze material. That is, braze material having a lower melting point and fusing temperature than the parent material from which the plates and bar members are formed. Thus, the upper and lower surface of each plate member 24', as well as the side surfaces of each bar member 26' and 28' has thereon a braze material which, when confronted with similar brazed material, or with the parent material, and subjected to a furnace braze operation will fuse together into a unitary structure. Consideration of the way in which the bar members 26' and 28' lay upon each plate member 24' will reveal that the side surfaces of the bar members are touching surfaces of the plate members which have braze material thereon. Similarly, the side surfaces of the bar members 26' and 28' are received within the channels 36' of corner bar member 14' so that these surfaces fuse together during a brazing operation. On the other hand, the abutment surfaces 42 of the bar members 26' and 28' are without braze material but are held in tight engagement with one another by vertical pressure (arrow 44) applied thereto during the brazing operation. The applicants believe that this pressure and constraint of the corner bar members at their abutment surfaces (42) in conjunction with the flow or wicking of braze alloy during brazing will result in these surfaces also fusing together to form a very strong unitary structure for the heat exchanger 10'. In other words, braze alloy from the surfaces of the bar members 26' and 28', as well as from within the channels 36' will wick between surfaces 42.

Viewing now FIG. 4, yet another alternative embodiment for the heat exchanger 10 is depicted. Because of the similarity of the structure depicted in FIG. 4 with that depicted in FIGS. 1 through 3, the same reference numerals used previously are employed on FIG. 4 with a double prime added. The heat exchanger depicted in FIG. 4 includes plate numbers 24'', fine- dimension fin sheet members 30'' and bar members 26'' and 28''. However, in this case the bar members 26'' and 28'' include end portions 40'' which are generally of L-shape with respect to the remainder of each bar portion. Those ordinarily skilled in the heat exchanger art will recognize that the depicted structures are repeated at the other corners of the heat exchanger, and in this case the opposite end portions 40'' of the bar members 26 and 28 extend in the same direction as that depicted so that the bar members 26'' and 28'' may also be envisioned as being of shallow U-shape.

As shown, each bar member 26'' and its mating bar member 28'' interlock to capture therebetween a plane rectangular plate member 25''. The plate member 25'' has braze material on its opposite surfaces, which contacts the edge surfaces 46 of the bar members 26'' and 28''. Thus, each engaging pair of bar members 26'' and 28'' are fused together during the furnace brazing operation. Similarly the plate members 24'' which include cruciform extension portions 48 are received on opposite sides of each engaging pair of bar members 26'' and 28''. Because the engaging pairs of bar members 26'' and 28'' define coplanar abutment surfaces 42, these surfaces may lay upon the plate members 24'' and the cruciform edge extensions 48, thereof. Thus, during the furnace brazing operation the paired bar members 26'' and 28'', the intervening plate 25'' and the fin sheets 30'' are joined together with the next adjacent pair of stacked bar members by the intervening plate member 24'' with its cruciform extension portions 48. Also, it is appropriate to note that the end portions 40'' are themselves cruciform in plan view, and are received into the channels 36'' of the corner bar member 14''. The side surfaces of these bar members 26'' and 28'' also are coated with braze material so that the corner bar 14'' and, the bar members 26'' and 28'' all fuse together during the brazing operation.

Recalling FIGS. 1–4 in conjunction, it will be appreciated that each of the embodiments of the Applicants inventive heat exchanger are also somewhat self-fixturing during manufacturing. That is, the corner bar members 14 with channels 36 provide guidance for stacking the individual components of the heat exchanger prior to brazing. On the other hand, the corner bar member 14 may also be configured as a simple V-shaped channel member without channels 36''. The V-shaped channel can be laid into the V-shape defined by the cruciform corner construction, and be brazed in place.

We claim:

1. A heat exchanger of the bar-and-plate type; said heat exchanger including a plurality of stacked, spaced apart plate members separating interleaved in laterally spaced apart pairs with said plate members to space apart said plate members and to bound said heat exchange fluid streams at respective lateral margins of said heat exchanger, said pairs of bar members alternating to angular intersect in plan view at vertices of said plate members and including transecting end-extension portions; and an elongate corner bar member of double-U shape in cross section extending in the direction of stacking of said plate members to defined a pair of channels opening in intersecting directions, said corner bar member captively receiving respective end-extension portions of said bar members into said channels to interlock therewith, said end-extension portions of said bar members being generally L-shaped to also extend in said stacking direction and defining confronting coplanar abutment surfaces within said channels of said corner bar members, alternate plate members of said plurality of plate members also including cruciform extension portions at the vertices thereof, said cruciform extensions extending between said confronting coplanar abutment surfaces.

2. The invention of claim 1 wherein said corner bar member also defines an elongate plenum-mounting surface bounding a face of said heat exchanger.

3. The invention of claim 2 wherein said corner bar member defines a pair of elongate plenum-mounting surfaces each bounding a respective face of said heat exchanger.

4. The invention of claim 1 further including a plurality of fine-dimension fin sheet members interdigitated with said plate members, said fin sheets defining a plurality of right-angle serpentine bends and engaging in heat-exchanger relation with said plate members.

5. The invention of claim 1 wherein alternate plate members of said plurality of plate members are without said cruciform extension portions and are sandwiched between enmeshed pairs of said L-shaped bar members having end-extension portions extending in opposite directions.

6. A method of making a bar-and-plate type heat exchanger having corners and a plurality of stacked space apart plate members interdigitating with a plurality of laterally spaced apart paired elongate bar members; said method including the steps of: providing an elongate corner bar member for each corner of said heat exchanger, said corner bar members being of double-U shape in cross section to define a pair of elongate channels;

relatively spacing said corner bar members in mutually parallel relation at said corners of said heat exchanger;

successively stacking plate members and paired bar members within said corner bar members, said bar members being received at end extension portions thereof into respective one of said channels, and disposing alternating layers of said bar members in intersecting angular relation to be captively received into said corner bar member channels;

providing said bar members with end extension portions also extending transversely to the length of said bar members;

configuring said end extension portions to captively interlock within said channels of said corner bar member and to define opposed L-shapes with the remainder of said bar members;

forming said extension portions to define coplanar abutment surfaces;

providing cruciform extension portions at the corners of alternate plate members; and extending said cruciform extension portions between said abutment surfaces of said bar members end extension portions.

7. A rectangular bar-and-plate type heat exchanger having stacked spaced apart plate members separating interleaved heat exchange fluid streams, and defining respective opposed inlet and outlet faces streams, and defining respective opposed inlet and outlet faces for each of said fluid streams, and laterally spaced apart pairs of bar members interdigitated with said plate members to both space apart said plate members and to laterally bound said heat exchange streams, said bar members at successive layers of said heat exchanger stack alternately extending perpendicularly to one another to intersect at corners of said heat exchanger, and said bar members each including an end extension portion transecting adjacent bar members and extension portions to define a cruciform at said corners of said heat exchanger, said bar members include at each end thereof an end extension portion defining with the remainder of said bar member an L-shape, the end extension portions of each bar member extending in the same direction to thereby define a shallow U-shape for said bar members, adjacent bar members in said heat exchanger stack having the shallow U-shape opening in opposite directions to interengage said end extension portions which define coplanar abutment surfaces, said heat exchanger further including an elongate corner bar member at each corner of said heat exchanger, said corner bar member of double-U shape in cross section to define a pair of channels opening perpendicularly to one another, said corner bar members extending perpendicularly to both the plane of said plate members, and to said bar members to receive said bar members at said cruciform captively into said channels, and alternate plates of said plurality of plates defining cruciform corner extension portions extending into said corner bar channels and between said coplanar abutment surfaces of said bar members.

8. The invention of claim 7 further including alternative plates of said plurality of plates being captured between interengaged bar members.

9. The invention of claim 7 further including a fine-dimension fin sheet of right angle serpentine shape received between each spaced apart plate member and the next adjacent stacked plate member.

* * * * *

UNITED STATES PATENT AND TRADEMARK OFFICE

CERTIFICATE OF CORRECTION

PATENT NO. : 5,183,106

DATED : Feb. 2, 1993

INVENTOR(S) : A. Colin Stancliffe, Paul Vidano and Bill P. Pogue

It is certified that error appears in the above-identified patent and that said Letters Patent is hereby corrected as shown below:

Col. 4, line 24, after "interleaved" insert -- heat exchange fluid streams; and a plurality of bar members interleaved --;

line 33, change "defined" to -- define --;

line 68, change "space" to -- spaced --.

Col. 5, line 33-34, delete "and defining respective opposed inlet and outlet face streams,".

Signed and Sealed this

Twenty-third Day of November, 1993

Bruce Lehman

*Attest:*

BRUCE LEHMAN

*Attesting Officer*

*Commissioner of Patents and Trademarks*